US008749597B2

(12) United States Patent
Hung et al.

(10) Patent No.: US 8,749,597 B2
(45) Date of Patent: Jun. 10, 2014

(54) MULTI-FRAME OVERDRIVING CIRCUIT AND METHOD AND OVERDRIVING UNIT OF LIQUID CRYSTAL DISPLAY

(75) Inventors: Ming-Chi Hung, Hsin-Chu (TW); Chih-Lin Liao, Hsin-Chu (TW); Hung-Min Shih, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 1463 days.

(21) Appl. No.: 12/078,373

(22) Filed: Mar. 31, 2008

(65) Prior Publication Data

US 2009/0147029 A1 Jun. 11, 2009

(30) Foreign Application Priority Data

Dec. 5, 2007 (TW) ..... 96146299 A

(51) Int. Cl.
*G09G 5/10* (2006.01)

(52) U.S. Cl.
USPC ..... 345/691; 345/690; 345/692; 345/693

(58) Field of Classification Search
USPC ..... 345/690–693
See application file for complete search history.

(56) References Cited

U.S. PATENT DOCUMENTS 6,624,880 B2 9/2003 Sandstrom et al.
2006/0209095 A1 * 9/2006 Hsu ..... 345/690

FOREIGN PATENT DOCUMENTS

TW 200729128 A 8/2007

OTHER PUBLICATIONS

Office Action issued from the Taiwan Intellectual Property Office on Jul. 27, 2012.

* cited by examiner

*Primary Examiner* — William Boddie
*Assistant Examiner* — Saifeldin Elnafia
(74) *Attorney, Agent, or Firm* — Bacon & Thomas, PLLC

(57) ABSTRACT

A multi-frame overdriving circuit for use in a liquid crystal display including a counting unit and a multi-frame overdriving unit is provided. The counting unit counts a number m of frame periods for which a pixel data corresponding to a pixel keeps a first gray value, wherein m is a positive integer. When the pixel data changes to a second gray value from the first gray value in a first frame period, the multi-frame overdriving unit respectively outputs y multi-frame overdriving pixel data corresponding to the pixel within successive y frame periods starting from the first frame period. The y multi-frame overdriving pixel data are related to the first gray value, the second gray value and the number m of frame periods, wherein y is a positive integer.

8 Claims, 8 Drawing Sheets

MULTI-FRAME OVERDRIVING CIRCUIT AND METHOD AND OVERDRIVING UNIT OF LIQUID CRYSTAL DISPLAY

This application claims the benefit of Taiwan Patent application Serial No. 96146299, filed Dec. 5, 2007, the subject matter of which is incorporated herein by reference.

BACKGROUND OF THE INVENTION

1. Field of the Invention

The invention in general relates to a multi-frame overdriving circuit of a liquid crystal display (LCD) and a method and an overdriving unit, and more particularly to a multi-frame overdriving circuit of an LCD and a method and an overdriving unit capable of reducing motion blur.

2. Description of the Related Art

The response time of a liquid crystal molecule has much to do with the cross-voltage at two ends of the liquid crystal molecule, and an overdriving method is normally used for increasing the response speed of the liquid crystal molecule. On the part of large-scale liquid crystal panel, a dual-frame overdriving method is further used for improving the response time of overall liquid crystal molecules to compensate corresponding image frames.

FIG. 1 shows a perspective of a conventional dual-frame overdriving circuit. The dual-frame overdriving circuit 100 includes a buffer 110, a first overdriving unit 120 and a second overdriving unit 130. The buffer 110 receives and stores the pixel data corresponding to a pixel. When the pixel data corresponding to the pixel changes to a second gray value from a first gray value in a first frame period, the first overdriving unit 120 outputs the first overdriving pixel data OD1 according to the first gray value and the second gray value in the first frame period. The second overdriving unit 130 outputs the second overdriving pixel data OD2 according to the first gray value and the second gray value in a second frame period next to the first frame period. However, when the pixel data changes to a higher gray value from a lower gray value, as liquid crystal molecules rotate slower at lower gray value, motion blur will occur on the image frame and thus the display quality of the image frame is deteriorated. The conventional dual-frame overdriving method can only compensate the image up to two frame periods.

When an image is moving at a fixed speed viewable to the naked eyes, a dynamic image with shorter width will result in shorter motion blur on the image frame, and a dynamic image with wider width will result in longer motion blur on the image frame. Referring to FIG. 2A, a perspective of motion blur on a conventional image frame is shown. In FIG. 2A, dynamic images A, B and C (dotted areas) with different data widths respectively result in motion blurs A', B' and C' with different lengths. For example, the motion blurs A', B' and C' respectively keep three, four and five frame periods. When the motion blurs A', B' and C' keep more than two frame periods, the conventional dual-frame overdriving technology can not perform complete compensation, causing abrupt indention to the transmittance curve of liquid crystal molecules in the third frame period as indicated in FIG. 2B. Thus, the display quality of the image frame can not be improved.

SUMMARY OF THE INVENTION

The invention is directed to a multi-frame overdriving circuit of an LCD and a method and an overdriving unit using a memory with smaller capacity to perform compensation in corresponding successive multiple frame periods so as to reduce the motion blur on image frames.

According to a first aspect of the present invention, a multi-frame overdriving circuit for use in a liquid crystal display including a counting unit and a multi-frame overdriving unit is provided. The counting unit counts a number m of frame periods for which a pixel data corresponding to a pixel keeps a first gray value, wherein m is a positive integer. When the pixel data changes to a second gray value from the first gray value in a first frame period, the multi-frame overdriving unit respectively outputs y multi-frame overdriving pixel data corresponding to the pixel within successive y frame periods starting from the first frame period. The y multi-frame overdriving pixel data are related to the first gray value, the second gray value and the number m of frame periods, wherein y is a positive integer.

According to a second aspect of the present invention, a multi-frame overdriving method for driving a liquid crystal display is provided. First, a number m of frame periods for which a pixel data corresponding to a pixel keeps a first gray value is counted, wherein m is a positive integer. Next, when the pixel data changes to a second gray value from the first gray value in a first frame period, y multi-frame overdriving pixel data corresponding to the pixel within successive y frame periods starting from the first frame period are respectively outputted. The y multi-frame overdriving pixel data are related to the first gray value, the second gray value and the number m of frame periods, wherein y is a positive integer.

According to a third aspect of the present invention, an overdriving unit for use in a liquid crystal display including a dual-frame overdriving circuit and a multi-frame overdriving circuit is provided. When a pixel data changes to a second gray value corresponding to a first frame period from a first gray value, the dual-frame overdriving circuit respectively outputs a first overdriving pixel data and a second overdriving pixel data in a first frame period and an adjacent second frame period. The first overdriving pixel data and the second overdriving pixel data are both related to the first gray value and the second gray value. The multi-frame overdriving circuit counts a number m of frame periods for which the pixel data corresponding to the pixel keeps the first gray value, and when the pixel data changes to the second gray value from the first gray value in the first frame period, y multi-frame overdriving pixel data corresponding to the pixel within successive y frame periods starting from a third frame period are respectively outputted. The y multi-frame overdriving pixel data are related to the first gray value, the second gray value and the number m of frame periods, wherein m and y are both positive integers. The third frame period is adjacent to the second frame period.

According to a fourth aspect of the present invention, an overdriving unit for use in a liquid crystal display including a single-frame overdriving circuit and a multi-frame overdriving circuit is provided. When a pixel data corresponding to a pixel changes to a second gray value from a first gray value in a first frame period, the single-frame overdriving circuit outputs a first overdriving pixel data in the first frame period. The first overdriving pixel data is related to the first gray value and the second gray value. The multi-frame overdriving circuit counts a number m of frame periods for which the pixel data corresponding to the pixel keeps the first gray value. When the pixel data corresponding to the pixel changes to the second gray value from the first gray value in the first frame period, y multi-frame overdriving pixel data corresponding to the pixel within successive y frame periods starting from the second frame period are respectively outputted. The y multi-frame overdriving pixel data are related to the first gray value, the second gray value and the number m of frame periods, wherein m and y are both positive integers. The second frame period is adjacent to the first frame period.

The invention will become apparent from the following detailed description of the preferred but non-limiting embodiments. The following description is made with reference to the accompanying drawings.

DETAILED DESCRIPTION OF THE INVENTION

The invention is directed to a multi-frame overdriving circuit of an LCD and a method and an overdriving unit. By means of the multi-frame overdriving circuit, a memory with smaller capacity is used for compensation within corresponding successive multiple frame periods so as to reduce the motion blur on image frames.

First Embodiment

Figure 3:
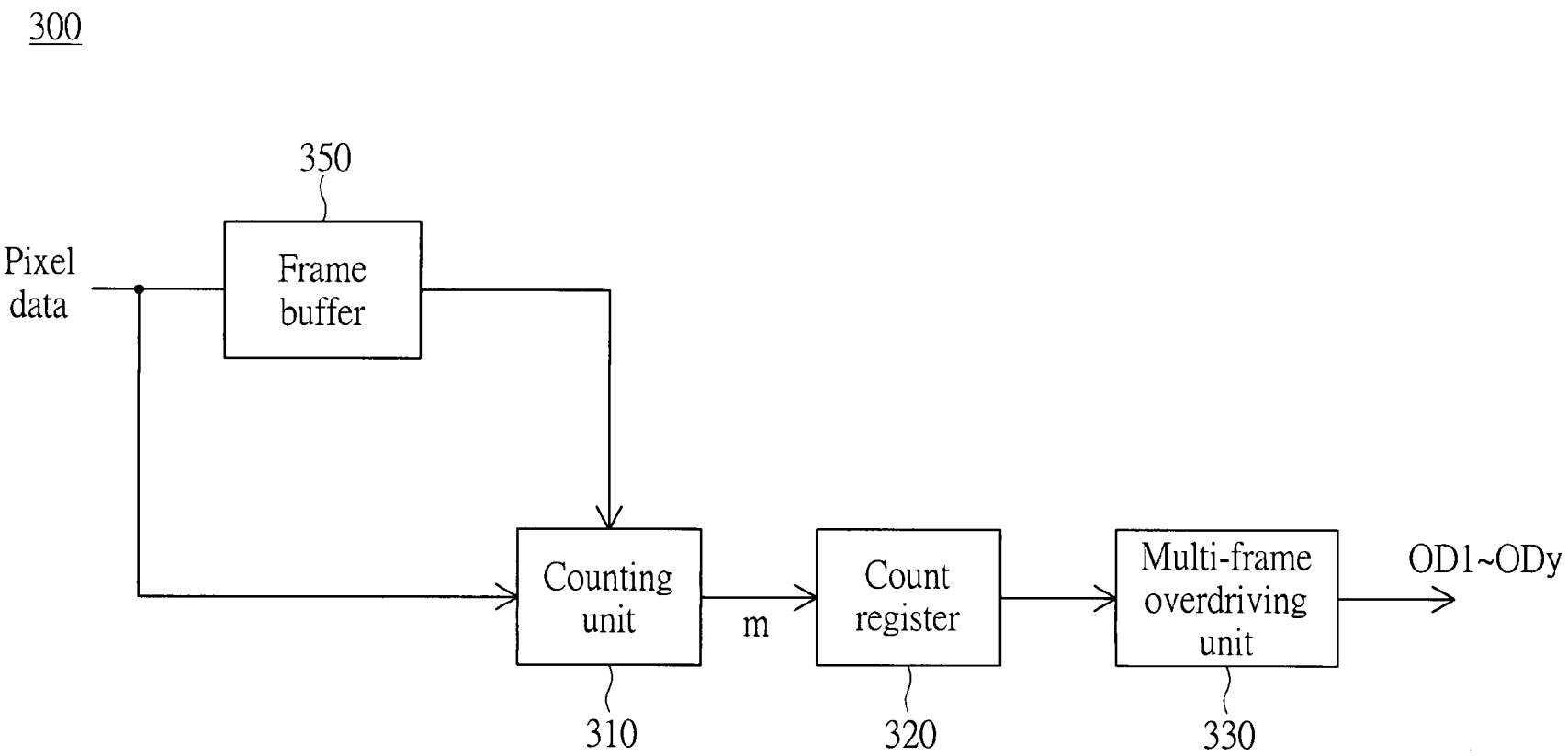
FIG. 3 shows a block diagram of a multi-frame overdriving circuit of an LCD according to a first embodiment of the invention.

FIG. 3 shows a block diagram of a multi-frame overdriving circuit of an LCD according to a first embodiment of the invention. The multi-frame overdriving circuit 300 includes a counting unit 310, a count register 320 and a multi-frame overdriving unit 330. The counting unit 310 counts a number m of frame periods for which a pixel data corresponding to a pixel keeps a first gray value, wherein m is a positive integer. The number m corresponds to the duration for which the pixel data corresponding to the single pixel keeps the first gray value. That is, if the pixel data corresponding to the single pixel displays the first gray value within successive m frames, the counting unit 310 counts the number m of frames. When the pixel data corresponding to the pixel changes to a second gray value from the first gray value in a first frame period, the multi-frame overdriving unit 330 respectively outputs y multi-frame overdriving pixel data corresponding to the pixel within successive y frame periods starting from the first frame period. The y multi-frame overdriving pixel data are related to the first gray value, the second gray value and the number m of frame periods, wherein y is a positive integer.

Figure 1:
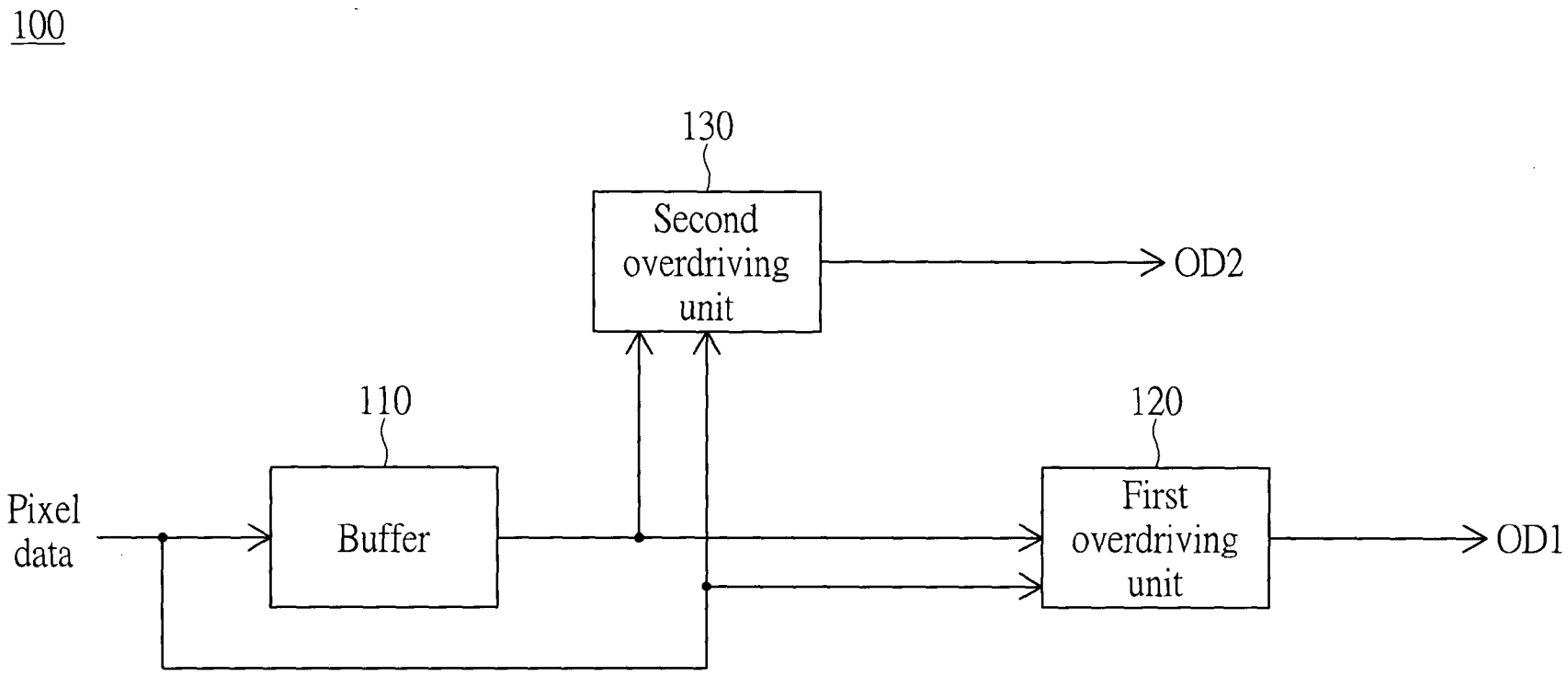
FIG. 1(RELATED ART)
FIG. 1 shows a perspective of a conventional dual-frame overdriving circuit.
Figure 2A:
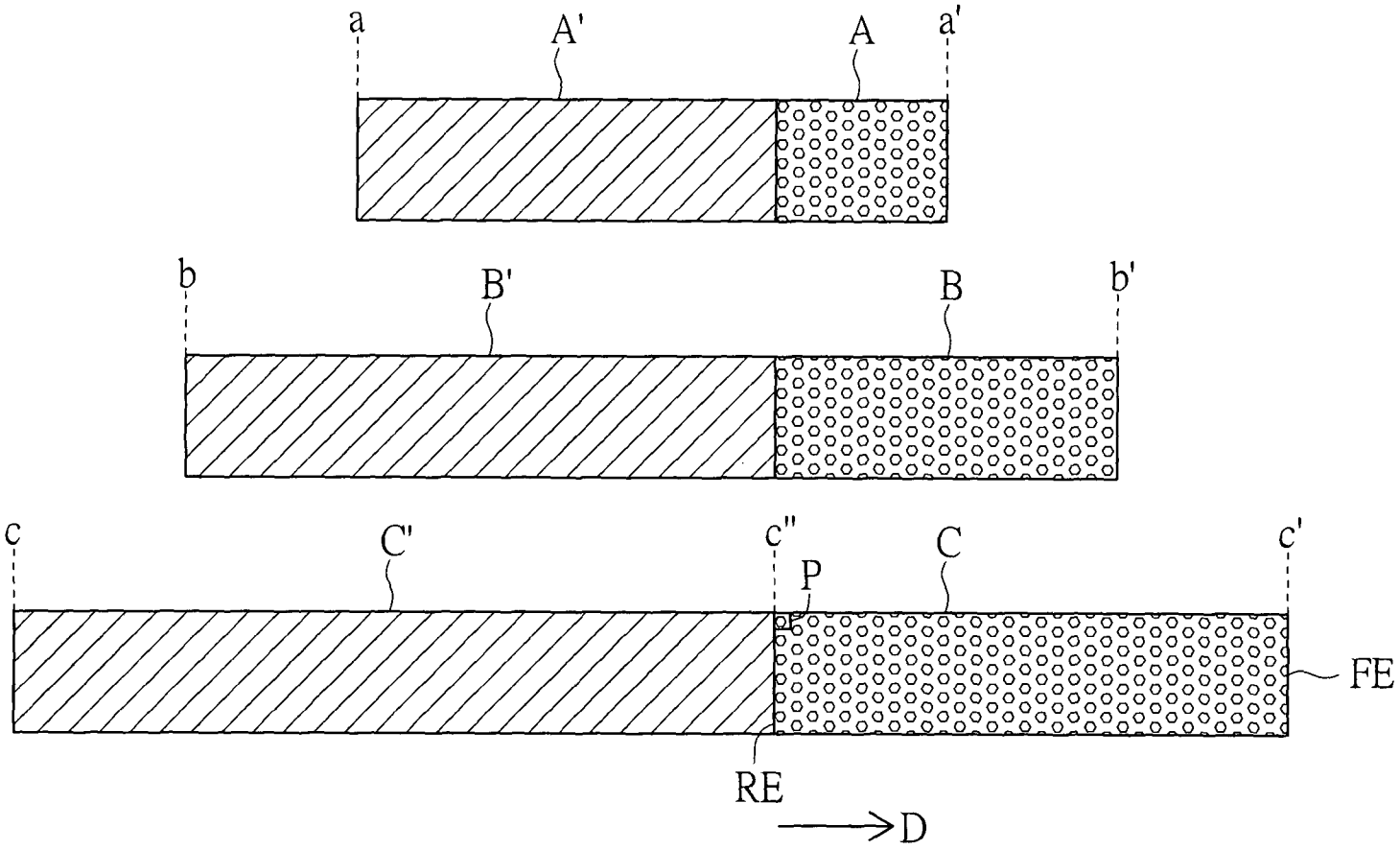
FIG. 2A(RELATED ART)
FIG. 2A shows a perspective of motion blur on a conventional image frame.
Figure 2B:
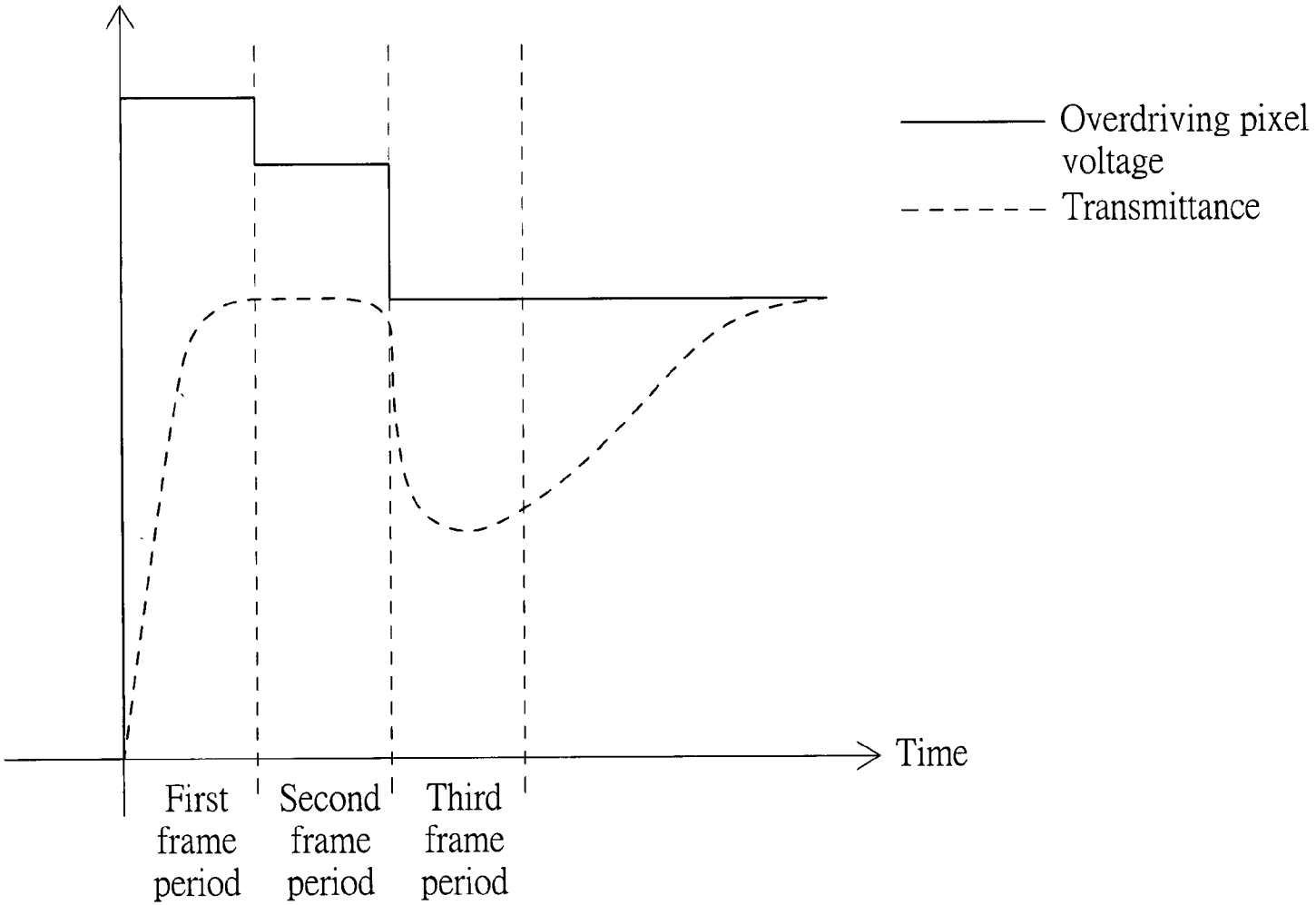
FIG. 2B(RELATED ART)
FIG. 2B shows a curve diagram of overdriving pixel voltage and transmittance vs time for conventional liquid crystal molecules.

As indicated in FIG. 2A, if the dynamic image C of FIG. 2A is a rectangular pattern of a single gray value GR and the dynamic image C moves forward along the direction D, then the pixel P begins to display the luminance corresponding to the gray value GR and keeps the luminance until the rear end RE of the dynamic image C leaves a position c" after the front edge FE of the dynamic image C enters the position c". As the dynamic image moves on the frame, the width and moving speed of the dynamic image substantially determine the number of frames which the pixel P displays the single gray value GR. The wider the width of the dynamic image is, the more frames the pixel P displays the single gray value GR due to the moving dynamic image. Moreover, the slower the dynamic image moves, the more frames the pixel P displays the single gray value GR due to the moving dynamic image. Therefore, the width and the moving speed of the dynamic image will affect the duration for which the pixel data corresponding to a particular pixel on the liquid crystal panel, that is, the number of frames for which the pixel data corresponding to a particular pixel keeps the same gray value is affected. As the image length of motion blur on an image frame (or the duration for which the blur keeps being displayed) has much to do with the width and moving speed of the dynamic image, the more frames for which the pixel data corresponding to a particular pixel keeps the same gray value, the longer the motion blur generated on the image frame will be. In the present embodiment of the invention, the counting unit 310 is used for counting the number m of frame periods for which the pixel data corresponding to each pixel keeps the same gray value, wherein m is a positive integer, so as to generate multiple overdriving pixel data corresponding to multiple frame periods for performing compensation on the to-be-displayed image in multiple frame periods, hence eliminating motion blur effectively.

The count register 320 is used for storing the number m of frame periods, and the register unit of a pixel corresponding to the number m of frame periods has n bits, wherein n is a positive integer, and $2^n$ is smaller than or equal to m. For example, if n is equal to 4, the count unit 310 can count the number of frame periods up to 16.

The second gray value substantially corresponds to the data of a current image frame displayed in the first frame period. Assume that the pixel data corresponds to a particular pixel keeps the first gray value for m frame periods before the first frame period. When the pixel data corresponding to the pixel changes to the second gray value in the first frame period, the multi-frame overdriving unit 330, according to a multi-frame overdriving look-up table, respectively outputs y multi-frame overdriving pixel data OD1~ODy corresponding to the pixel within successive y frame periods starting from the first frame period. The y multi-frame overdriving pixel data OD1~ODy are related to the first gray value, the second gray value and the number m of frame periods, wherein y is a positive integer. That is, as the value of m differs, the corresponding value y selected from the multi-frame overdriving look-up table also differs accordingly, and so will the gray values of the selected overdriving pixel data OD1~ODy differ. In addition, if y is larger than or equal to 3, compared to the conventional dual-frame overdriving circuit, the multi-frame overdriving circuit 300 of the present embodiment of the invention has better compensation effect in the corresponding image frames.

In addition, liquid crystal molecules with different characteristics have different duration of image blur. Preferably, the multi-frame overdriving look-up table is designed according to the characteristics of the liquid crystal molecules, so that y and the gray values of the overdriving pixel data OD1~ODy are adjusted according to the characteristics of the liquid crystal molecules.

For example, if the pixel data keeps gray value 20 in 3 frame periods before the first frame period, then the value of m is 3. When the pixel data changes to gray value 25 from gray value 20 in the first frame period, the multi-frame overdriving unit 330 determines the value of y as 4 according to the multi-frame overdriving look-up table when the starting gray value is 20, the finishing gray value is 25, and m is equal to 3. Also, the values of the multi-frame overdriving pixel data OD1~OD4 are determined according to the multi-frame overdriving look-up table. Then, the multi-frame overdriving unit 330 respectively outputs the multi-frame overdriving pixel data OD1~OD4 in the subsequent first to the fourth frame periods. The sequential gray values of the multi-frame overdriving pixel data OD1~OD4 are exemplified by 32, 29, 27 and 26. Thus, the images to be displayed in the subsequent first to the fourth frame periods are compensated, and thus the motion blur is effectively eliminated.

In the multi-frame overdriving circuit 300 disclosed above, a single pixel is exemplified as a display unit. However, the single pixel substantially includes three sub-pixels for displaying red (r), green (g) and blue (b) respectively, so the multi-frame overdriving circuit 300 can also be used in an embodiment where a single sub-pixel is a display unit. That is, the multi-frame overdriving circuit 300 is also applicable to the sub-pixel data corresponding to the sub-pixel according to the same principles as disclosed above and is omitted here.

Figure 4:
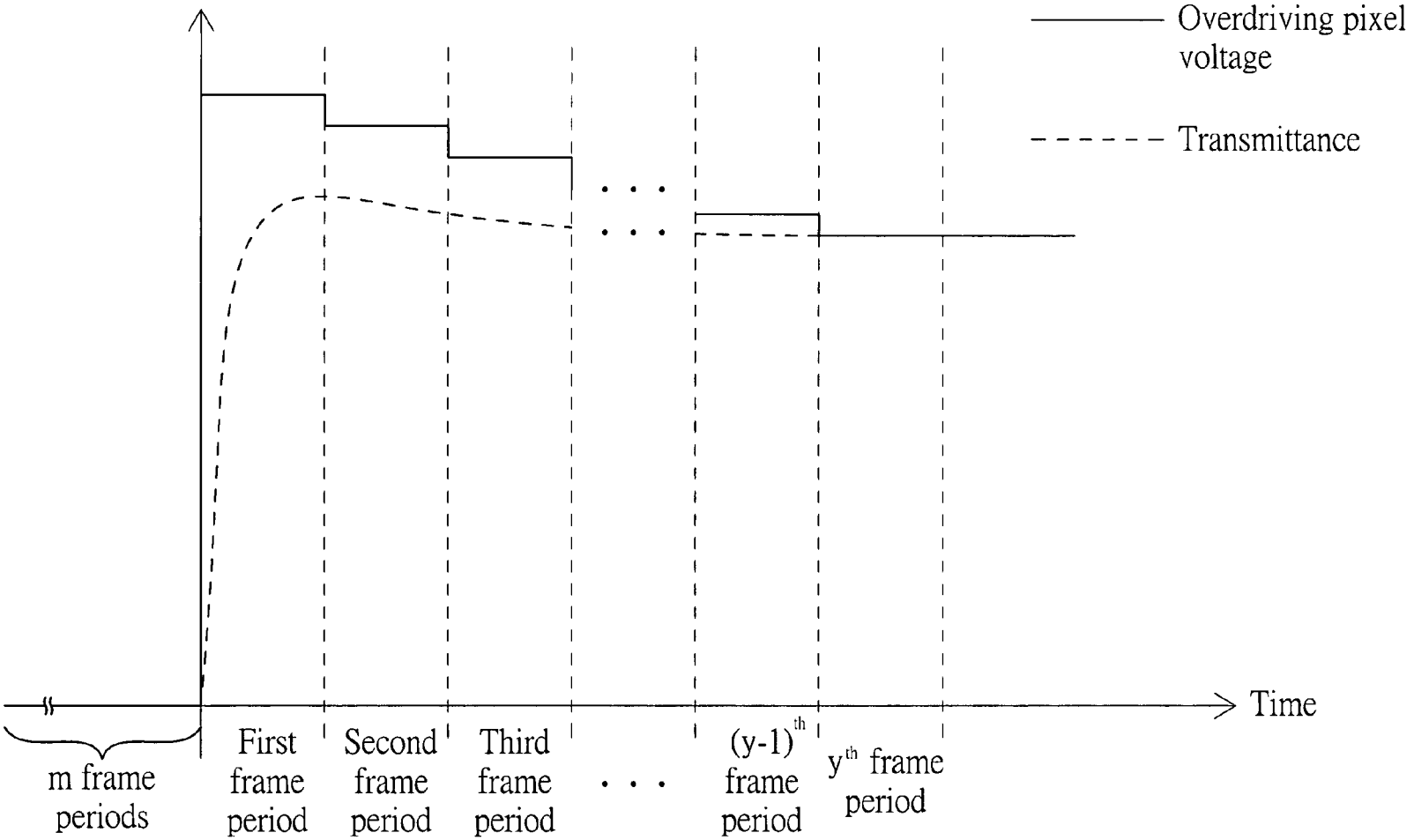
FIG. 4 shows a curve diagram of overdriving pixel voltage and transmittance vs time for the liquid crystal molecules according to the first embodiment of the invention.

Referring to FIG. 4, a curve diagram of overdriving pixel voltage and transmittance vs time for the liquid crystal molecules according to the first embodiment of the invention is shown. As indicated in FIG. 4, y multi-frame overdriving pixel data OD1~ODy respectively perform compensation on the image frame within successive y frame periods starting from the first frame period. Therefore the transmittance curve of liquid crystal molecules is a smooth curve instead of a concave curve which would occur in conventional method, and the motion blur is effectively eliminated.

In addition, if the pixel data changes to a third gray value from the second gray value after z frame periods when the pixel data corresponding to the pixel changes to the second gray value, wherein z is a positive integer smaller than y, then the multi-frame overdriving unit 330 will abort the (y−z) multi-frame overdriving pixel data which have not yet been outputted and perform another stage of multi-frame overdriving.

In the another stage of multi-frame overdriving, the multi-frame overdriving unit 330 respectively outputs y' multi-frame overdriving pixel data corresponding to the pixel within successive y' frame periods starting from the $(z+1)^{th}$ frame period in which the multi-frame overdriving unit 330 changes to the third gray value. The y' multi-frame overdriving pixel data are related to the second gray value, the third gray value, and a number m' of frame periods for which the pixel data keeps the second gray value, m' and y' are a positive integer. The number m' of frame periods is substantially equal to z.

For example, when the pixel data changes to gray value 25 from gray value 20 in the first frame period, the multi-frame overdriving unit 330 respectively outputs multi-frame overdriving pixel data OD1~OD4 in the subsequent first frame period to the fourth frame period. The sequential gray values of the multi-frame overdriving pixel data OD1~OD4 are exemplified by 32, 29, 27 and 26. However, if the pixel data Data changes to gray value 40 from gray value 25 in the third frame period, then after the multi-frame overdriving unit 330 respectively outputs gray value 32 and 29 in the first frame period to the second frame period, the multi-frame overdriving unit 330 will abort the gray values 27 and 26 corresponding to the third frame period and the fourth frame period and will perform another stage of multi-frame overdriving. For example, from the first frame period to the second frame period, the pixel data keeps gray value 25, so the updated value of m is 2. The multi-frame overdriving unit 330 generates new multi-frame overdriving pixel data to display the image of multiple frame periods following the third frame period according to the gray value 25, the gray value 40 and the updated value of m which is equal to 2.

In addition, the multi-frame overdriving circuit 300 further includes a frame buffer 350 for receiving and storing the pixel data corresponding to the pixel. For example, the pixel data corresponds to one frame period previous to the first frame period of the current frame. That is, the frame buffer 350 stores the gray value corresponding to a previous image frame such as the first gray value.

Figure 5:
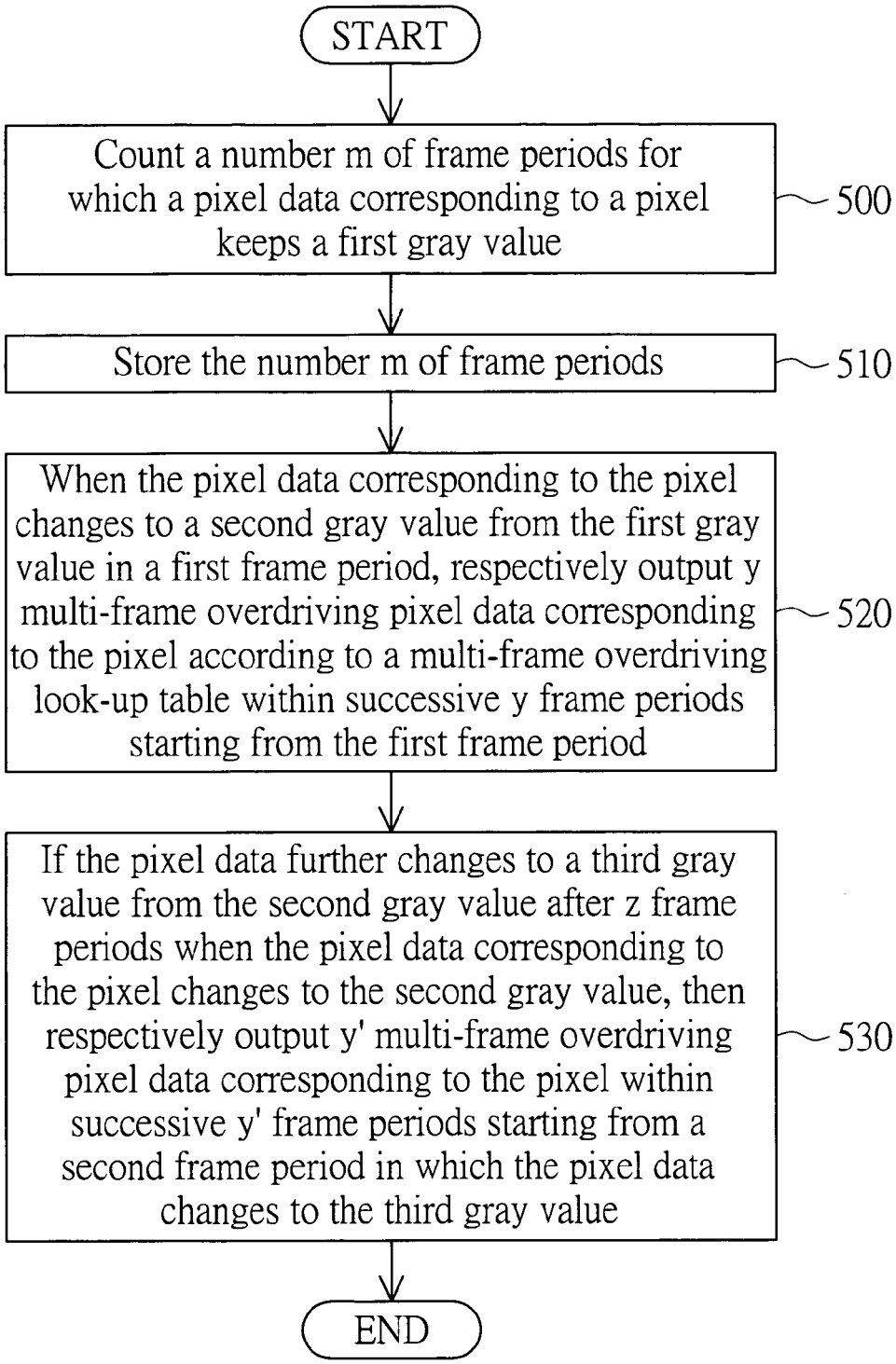
FIG. 5 shows a flowchart of a multi-frame overdriving method of an LCD according to the invention.

The invention further discloses a multi-frame overdriving method of an LCD. FIG. 5 shows a flowchart of a multi-frame overdriving method of an LCD of the invention. Firstly, the method begins at step 500, a number m of frame periods for which a pixel data corresponding to a pixel keeps a first gray value is counted, wherein m is a positive integer. Then, the method proceeds to step 510, the number m of frame periods is stored.

In step 520, when the pixel data corresponding to the pixel changes to a second gray value from the first gray value in a first frame period, y multi-frame overdriving pixel data corresponding to the pixel are respectively outputted according to a multi-frame overdriving look-up table within successive y frame periods starting from the first frame period. The y multi-frame overdriving pixel data are related to the first gray value, the second gray value and the number m of frame periods, wherein y is a positive integer.

In step 530, if the pixel data further changes to a third gray value from the second gray value after z frame periods when the pixel data corresponding to the pixel changes to the second gray value, then y' multi-frame overdriving pixel data corresponding to the pixel are respectively outputted within successive y' frame periods starting from a second frame period in which the pixel data changes to the third gray value. The y' multi-frame overdriving pixel data are related to the second gray value, the third gray value, and the number m' of frame periods for which the pixel data keeps the second gray value, wherein m', y' and z are positive integers, z is smaller than y. The number m' of frame periods is substantially equal to z.

The processing principles of the multi-frame overdriving method of an LCD are disclosed in the processing of the multi-frame overdriving circuit 300 and are omitted hereinafter.

Second Embodiment

Figure 6:
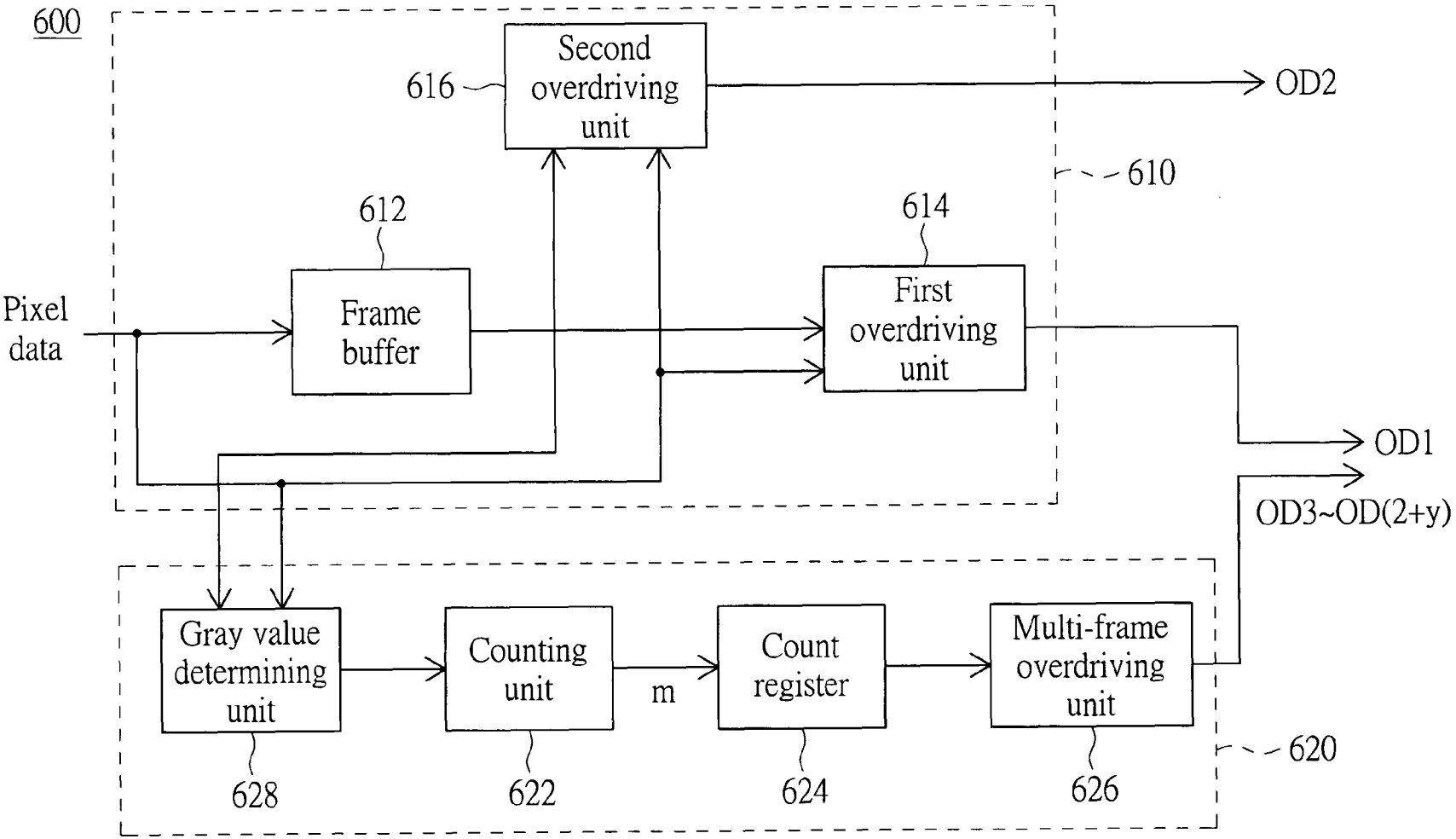
FIG. 6 shows a block diagram of a multi-frame overdriving circuit of an LCD according to a second embodiment of the invention.

FIG. 6 is a block diagram of a multi-frame overdriving circuit of an LCD according to a second embodiment of the invention. The overdriving unit 600 includes a dual-frame overdriving circuit 610 and a multi-frame overdriving circuit 620. The dual-frame overdriving circuit 610 includes a frame buffer 612, a first overdriving unit 614 and a second overdriving unit 616. The frame buffer 612 receives and stores a pixel data Data corresponding to a pixel.

When the pixel data Data corresponding to the pixel changes to a second gray value from a first gray value in a first frame period, the first overdriving unit 614 outputs the first overdriving pixel data OD1 according to the first gray value and the second gray value in the first frame period. The second overdriving unit 616 outputs the second overdriving pixel data OD2 according to the first gray value and the second gray value in the second frame period next to the first frame period. The first gray value substantially corresponds to a previous image frame, and the second gray value substantially corresponds to a current image frame. The frame buffer 612 substantially stores the gray value corresponding to the previous image frame such as the first gray value.

The multi-frame overdriving circuit 620 includes a counting unit 622, a count register 624 and a multi-frame overdriving unit 626. The counting unit 622 counts a number m of frame periods for which the pixel data corresponding to the pixel keeps the first gray value, wherein m is a positive integer. The count register 624 stores the number m of frame periods.

When the pixel data corresponding to the pixel changes to a second gray value from the first gray value in the first frame period, the multi-frame overdriving unit 626 respectively outputs y multi-frame overdriving pixel data OD3~OD(2+y) corresponding to the pixel according to a multi-frame overdriving look-up table within successive y frame periods starting from the third frame period. The abovementioned y multi-frame overdriving pixel data OD3~OD(2+y) are related to the first gray value, the second gray value and the number m of frame periods, wherein y is a positive integer. The third frame period is adjacent to the second frame period.

In addition, if the pixel data corresponding to the pixel further changes to a third gray value from the second gray value after z frame periods when the pixel data changes to the second gray value, then the multi-frame overdriving unit 626 respectively outputs y' multi-frame overdriving pixel data corresponding to the pixel within successive y' frame periods starting from the $(z+1)^{th}$ frame period in which the pixel data is at the third gray value, wherein z is a positive integer smaller than y. The y' multi-frame overdriving pixel data are related to the second gray value, the third gray value and a number m' of frame periods for which the pixel data keeps the second gray value, wherein both m' and y' are positive integers. The number m' of frame periods is substantially equal to z.

In addition, motion blur on the image frame normally occurs when the pixel data corresponding to the pixel is at low gray value. Power consumption would be saved if the LCD adopts multi-frame overdriving technology only when pixel data is at low gray value. Preferably, the multi-frame overdriving circuit 620 further includes a gray value determining unit 628 for determining whether the gray value of the pixel data is lower than a predetermined gray value. If the gray value of the pixel data is higher than the predetermined gray value, then the counting unit 622 does not perform counting, and the multi-frame overdriving circuit 620 does not output the multi-frame overdriving pixel data.

Besides, in the overdriving unit 600, a single pixel is exemplified as a display unit. However, the single pixel substantially includes three sub-pixels for displaying red (r), green (g) and blue (b) respectively, so the multi-frame overdriving circuit 600 can also be used in an embodiment where a single sub-pixel is a display unit. The gray value determining unit 628 can determine whether the gray value of the sub-pixel data is lower than a predetermined gray value. If the gray value of the sub-pixel data is lower than the predetermined gray value, then the multi-frame overdriving circuit 620 processes the sub-pixel data. The processing principles are the same as the above disclosure and are omitted hereinafter.

The processing principles of the multi-frame overdriving circuit 620 of the LCD are disclosed in the processing of the multi-frame overdriving circuit 300 and are omitted hereinafter.

Third Embodiment

Figure 7:
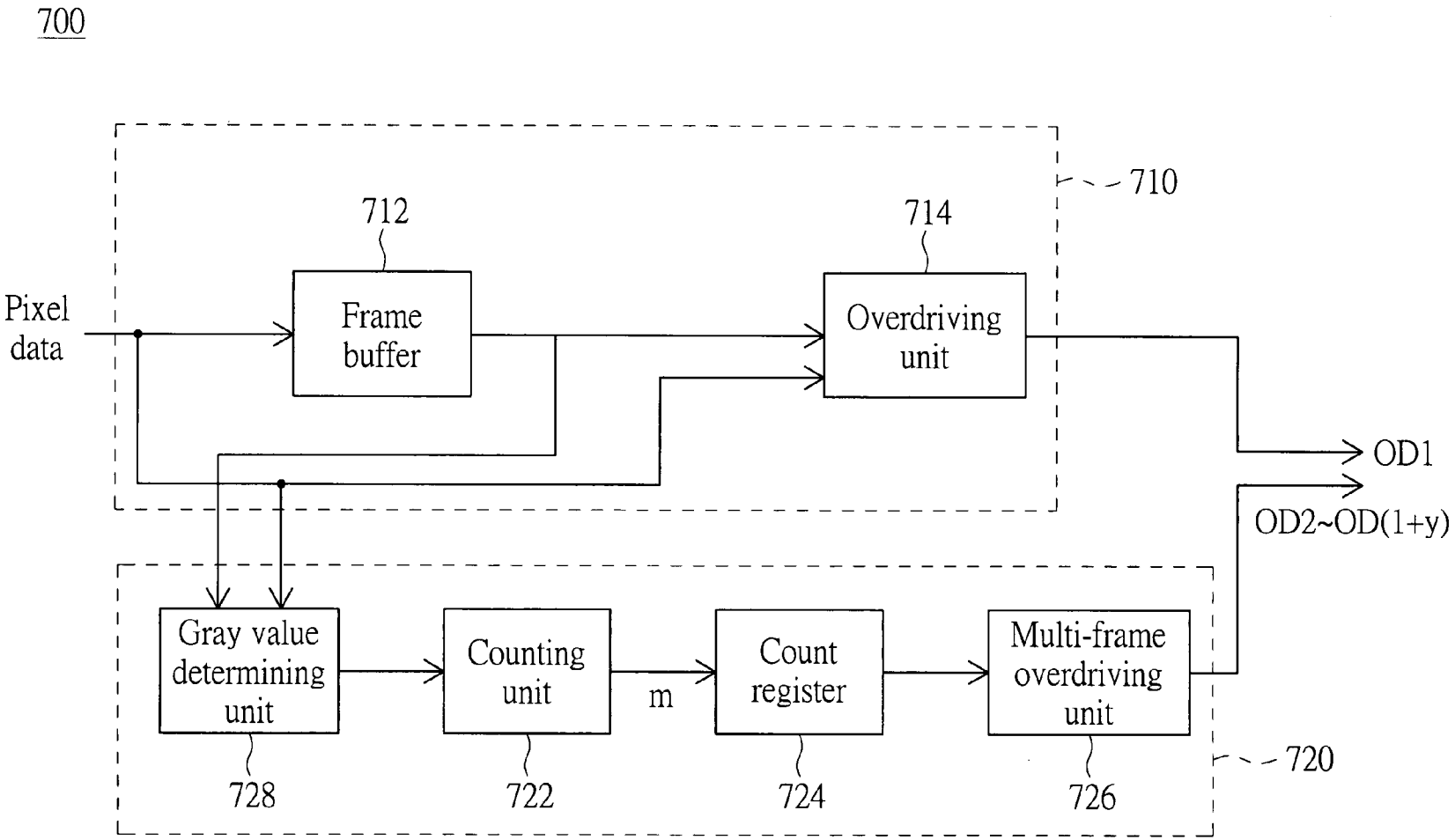
FIG. 7 shows a block diagram of a multi-frame overdriving circuit of an LCD according to a third embodiment of the invention.

FIG. 7 is a block diagram of a multi-frame overdriving circuit of an LCD according to a third embodiment of the invention. The overdriving unit 700 includes a single-frame overdriving circuit 710 and a multi-frame overdriving circuit 620. The single-frame overdriving circuit 710 includes a frame buffer 712 and an overdriving unit 714. The frame buffer 712 receives and stores a pixel data corresponding to a pixel.

When the pixel data corresponding to the pixel changes to a second gray value from a first gray value in a first frame period, the overdriving unit 714 outputs the first overdriving pixel data OD1 according to the first gray value and the second gray value in the first frame period. The first gray value substantially corresponds to the previous image frame, and the second gray value substantially corresponds to the current image frame. The frame register 712 substantially stores the gray value corresponds to the previous image frame such as the first gray value.

The multi-frame overdriving circuit 720 includes a counting unit 722, a count register 724 and a multi-frame overdriving unit 726. The counting unit 722 counts a number m of frame periods for which the pixel data corresponding to the pixel keeps the first gray value, wherein m is a positive integer. The count register 724 stores the number m of frame periods.

When the pixel data corresponding to the pixel changes to a second gray value from the first gray value in the first frame period, the multi-frame overdriving unit 726 respectively outputs y multi-frame overdriving pixel data OD2~OD(1+y) corresponding to the pixel according to a multi-frame overdriving look-up table (not shown) within successive y frame periods starting from the second frame period. The abovementioned y multi-frame overdriving pixel data OD2~OD(1+y) are related to the first gray value, the second gray value and the number m of frame periods, wherein y is a positive integer. The second frame period is next to the first frame period.

In addition, if the pixel data corresponding to the pixel further changes to a third gray value from the second gray value after z frame periods when the pixel data changes to the second gray value, then the multi-frame overdriving unit 726 respectively outputs y' multi-frame overdriving pixel data corresponding to the pixel within successive y' frame periods starting from the $(z+1)^{th}$ frame period in which the pixel data is at the third gray value, wherein z is a positive integer smaller than y. The y' multi-frame overdriving pixel data are related to the second gray value, the third gray value and a number m' of frame periods for which the pixel data keeps the second gray value, wherein both m' and y' are positive integers. The number m' of frame periods is substantially equal to z.

In addition, motion blur on the image frame normally occurs when the pixel data corresponding to the pixel is at low gray value. The multi-frame overdriving circuit 720 further includes a gray value determining unit 728 for determining whether the gray value of the pixel data is lower than a predetermined gray value. If the gray value of the pixel data is higher than the predetermined gray value, then the counting unit 722 does not perform counting, and the multi-frame overdriving circuit 720 does not output the multi-frame overdriving pixel data.

The processing principles of the multi-frame overdriving circuit 720 of the LCD are disclosed in the processing of the multi-frame overdriving circuit 620 and are not repeated here.

A multi-frame overdriving circuit of an LCD and a method and an overdriving unit thereof are disclosed in the above embodiments of the invention. The multi-frame overdriving circuit performs compensation within successive multiple frame periods, so that the transmittance curve of liquid crystal molecules is a smooth curve free of abrupt indention, and thus the motion blur is effectively eliminated.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-frame overdriving circuit for use in a liquid crystal display, comprising:

a counting unit for counting a number m of frame periods for which a pixel data corresponding to a pixel keeps a first gray value, wherein m is a positive integer; and a multi-frame overdriving unit for respectively outputting y multi-frame overdriving pixel data corresponding to the pixel within successive y frame periods starting from a first frame period when the pixel data corresponding to the pixel changes to a second gray value from the first gray value in the first frame period, wherein y is a positive integer larger than 1, and the value of y is determined according to the first gray value, the second gray value and the number m of frame periods;

wherein if the pixel data changes to a third gray value from the second gray value after z frame periods when the pixel data corresponding to the pixel changes to the second gray value, then the multi-frame overdriving unit aborts (y-z) multi-frame overdriving pixel data which have not yet been outputted and respectively outputs y' multi-frame overdriving pixel data corresponding to the pixel within successive y' frame periods starting from a second frame period in which the multi-frame overdriving unit changes to the third gray value, wherein the y' multi-frame overdriving pixel data are related to the second gray value, the third gray value, and a number m' of frame periods for which the pixel data keeps the second gray value, where m', y' and z are positive integers, z is smaller than y.

2. The multi-frame overdriving circuit according to claim 1, further comprising:

a count register for storing the number m of frame periods.

3. The multi-frame overdriving circuit according to claim 1, wherein the multi-frame overdriving unit respectively outputs the y multi-frame overdriving pixel data according to a multi-frame overdriving look-up table within successive y frame periods starting from the first frame period.

4. The multi-frame overdriving circuit according to claim 1, further comprising:

a frame buffer for receiving and storing the pixel data corresponding to the pixel.

5. A multi-frame overdriving method for driving a liquid crystal display, the method comprising:

(a) counting a number m of frame periods for which a pixel data corresponding to a pixel keeps a first gray value, wherein m is a positive integer;

(b) respectively outputting y multi-frame overdriving pixel data corresponding to the pixel within successive y frame periods starting from a first frame period after the pixel data corresponding to the pixel changes to a second gray value from the first gray value in the first frame period, wherein y is a positive integer larger than 1, and the value of y is determined according to the first gray value, the second gray value and the number m of frame periods; and (c) if the pixel data further changes to a third gray value from the second gray value after z frame periods when the pixel data corresponding to the pixel changes to the second gray value, then aborting (y-z) multi-frame overdriving pixel data which have not yet been outputted and respectively outputting y' multi-frame overdriving pixel data corresponding to the pixel within successive y' frame periods starting from a second frame period in which the pixel data changes to the third gray value, wherein the y' multi-frame overdriving pixel data are related to the second gray value, the third gray value, and the number m' of frame periods for which the pixel data keeps the second gray value, where m', y' and z are positive integers, z is smaller than y.

6. The multi-frame overdriving method according to claim 5, wherein step (a) further comprises:

(a1) storing the number m of frame periods.

7. The multi-frame overdriving method according to claim 5, wherein in step (b), the y multi-frame overdriving pixel data are respectively outputted according to a multi-frame overdriving look-up table within successive y frame periods starting from the first frame period.

8. The multi-frame overdriving method according to claim 5, further comprising:

(a2) receiving and storing the pixel data corresponding to the pixel.

* * * * *